United States Patent [19]

Jelínek

[11] Patent Number: 4,887,440

[45] Date of Patent: Dec. 19, 1989

[54] THREAD CUTTING DEVICE

[75] Inventor: Jan Jelínek, Třebíč, Czechoslovakia

[73] Assignee: ELITEX koncern textilniho strojirenstvi, Liberec, Czechoslovakia

[21] Appl. No.: 252,824

[22] Filed: Sep. 28, 1988

[30] Foreign Application Priority Data

Sep. 28, 1987 [CS] Czechoslovakia ..... 6922-87

[51] Int. Cl.[4] ..... D04B 15/61

[52] U.S. Cl. ..... 66/145 S

[58] Field of Search ..... 66/134, 140 R, 140 S, 66/145 R, 145 S

[56] References Cited

U.S. PATENT DOCUMENTS

| | | | |
|---|---|---|---|
| 3,557,578 | 1/1971 | Fetzer | 66/140 S |
| 3,831,501 | 5/1968 | Kaese et al. | 66/134 |
| 4,644,764 | 2/1987 | Wilkes | 66/140 S |

FOREIGN PATENT DOCUMENTS

| | | | |
|---|---|---|---|
| 173598 | 3/1975 | Czechoslovakia | 66/145 S |
| 1445646 | 8/1976 | United Kingdom . | |

*Primary Examiner*—Wm. Carter Reynolds

*Attorney, Agent, or Firm*—Klein & Vibber

[57] ABSTRACT

A thread cutting device in a circular knitting machine for the production of hosiery goods. The device is arranged on the dial and it consists of a circular cutting saw and a stationary cutting blade cooperating with it. Above the circular cutting saw there is arranged a shaped element so that on a part of the arc in front of the stationary cutting blade with respect to the rotary direction of the circular knitting machine it covers its teeth. Above said part of the arc of the shaped element in the path of the threads drawn by the needles there is arranged a projection for the purpose of lengthening the thread ends between the needle and the circular cutting saw.

3 Claims, 1 Drawing Sheet

THREAD CUTTING DEVICE

BACKGROUND OF THE INVENTION

The invention relates to a thread cutting device in a circular knitting machine for the production of hosiery goods, which contains a stationary cutting blade arranged on the dial, a circular cutting saw and a shaped element arranged above it so that on the part of the arc of the dial disposed in front of the stationary cutting blade the shaped element covers the teeth of the circular cutting saw.

It is known that in the circular knitting machines with a cutting device of the above mentioned type as is, for example, described in Czechoslovak Pat. No. 173,598 when knitting socks with cut-out panel patterns, the ends of the threads are so short, that when stretching and extending the fabric, a transfer to the fabric face takes place. This deteriorates the product quality of the knitted fabric.

SUMMARY OF THE INVENTION

It is an object of the present invention to eliminate the above described disadvantage in the circular knitting machine being provided with dial needle sinkers. This is principally achieved by a projection disposed above a part of a shaped element and in front of the stationary cutting blade relative to the rotary direction of the knitting machine in the path of the threads being drawn in by the needles. This projection is arranged for the purpose of lengthening the end of the thread between the needle and the circular cutting saw.

The advantage of the invention resides in that the threads fed in and out are bent over said projection thereby decreasing the angle between the thread and the cutting plane of the circular cutting saw and prolongation of the distances between the first or the last knitting needle and the tooth of the saw and thereby also lengthening the distance at which the cut end is situated with respect to the formed loop.

BRIEF DESCRIPTION OF THE DRAWING

For an understanding of the principles of the invention, reference is made to the following description of a typical embodiment thereof as illustrated in the accompanying drawings.

DETAILED DESCRIPTION

Figure 2:
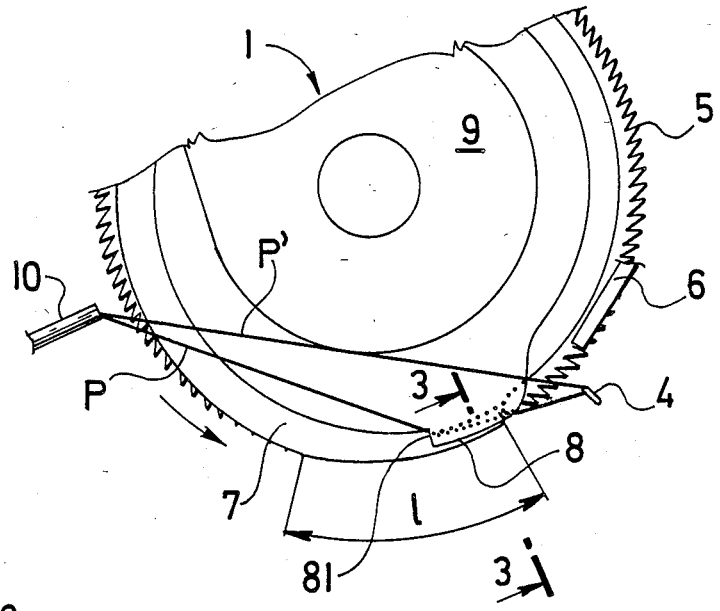
FIG. 2 is a partial schematic top plan view, with illustrated guidance of the thread fed out from the needles before cutting.
Figure 3:
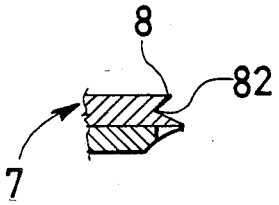
FIG. 3 is a section of the projection with a cutout in the place of the section line 3—3 according to FIG. 2.

A known single cylinder circular knitting machine for the production of knitted socks is provided with a dial 1 rototably mounted above the needle cylinder 2. In the dial 1 there are operatively reciprocally mounted the dial sinkers 3 which cooperate with the cylinder needles 4 when transferring the double welt. There is arranged on the dial 1 a thread cutting device consisting of the following parts: a circular cutting saw 5 which co-acts with a stationary cutting blade 6. A shaped element 7 is mounted above the circular cutting saw 5 or around its circumference. This shaped element 7 covers the teeth of the circular cutting saw 5 on a part of its circumference in front of the stationary cutting blade 6 with respect to the rotary direction, said covered part being of the length 1 (see FIG. 2). A projection 8 is disposed above a portion of said length 1 on the shaped element 7. The projection 8 is of an arcuate shape, while its cross-section has the shape of a point, as is illustrated in FIG. 3. At the upstream end of the projection 8 relative to the rotary direction there is a transverse edge 81 to catch-up the thread P. The projection 8 with the remaining edge of the shaped element 7 form a cutout 82 in which there is laid the caught-up thread P fed to the first or to the last knitting needle 4, which entrains it. Further there is operatively mounted on the dial a pneumatic spout 9 to suck and hold free thread ends.

MANNER OF OPERATION

The operation of the above described device is as follow: When knitting the fabric, thread P for patterning is fed into the needles and fed out from the needles 4 by the guide 10 according to the program given by a patterning mechanism. When setting the guide 10 out of operation, thread P is entrained by the last knitting needle 4 and at the same time it is caught-up by a tooth of the circular cutting saw 5. Thread P is entrained also by a tooth of the circular cutting saw up to the place, where the shaped element 7 covers said circular cutting saw 5. Here, due to the action of the shaped element 7, the thread P is slipped out of engagement with the tooth of the circular cutting saw 5 and moves along the circumference and surface of the shaped element 7 along the length 1 that the place where it is caught-up by the transverse edge 81 of the projection 8. During further motion of the needle 4 thread P is laid into the cutout 82 of the projection 8 and then behind the projection 8 or behind the length 1 of the shaped element 7 where it is caught-up again by a tooth of the circular cutting saw 5, as illustrated in FIG. 2. For better understanding or illustration of the effect of the invention the reference sign P' illustrates how the thread would be placed should the knitting machine not be provided with the projection 8. Thread P or P' is then during further operation cut by the stationary cutting blade 6 and its free end is sucked into the pneumatic spout 9.

Figure 1:
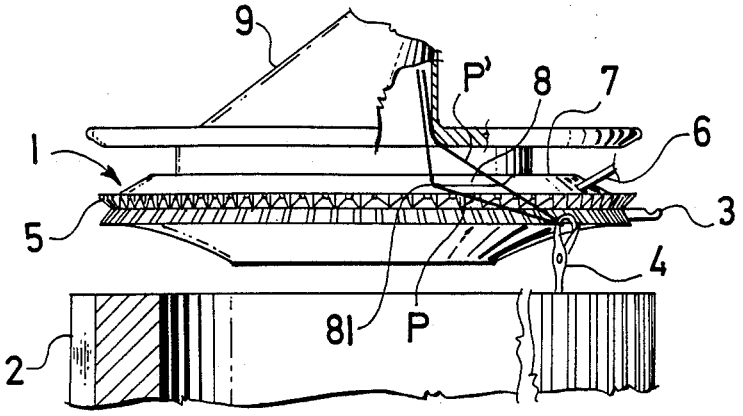
FIG. 1 is a schematic arrangement of the dial in a side elevational view with illustrated guide means for the thread end which is being held in a spout and fed into the needles before cutting.

When setting the thread guide 10 into an operative function, thread P is caught by the first operating needle 4 and it is knitted into the fabric. The free end of the thread P which is being sucked into the pneumatic spout 9 is caught during passage of the first operating needle 4 and bent over the transverse edge 81 of the projection 8 and thread P is again laid into the cutout 82, as illustrated in FIG. 1. Cutting of the thread P takes place in cooperation with the circular cutting saw 5 and the stationary cutting blade 6. FIG. 1 also illustrates how thread P' would be positioned should the machine not be provided with the projection 8.

In both cases of cutting the fed in and fed out thread P the latter bends over the projection 8 so that the angle between the thread P and the cutting plane of the circular cutting saw 5 is decreased and the distance between the knitting needle 4 and the tooth of the circular cutting saw 5 is thereby lengthened. Between the projection 8 and pneumatic spout 9 threads P are seized by the cutout 82 so that before cutting they are in fact disposed in a pneumatically inactive region so that their sucking into the pneumatic spout 9 and shortening of the ends of the threads being cut is not possible.

It is within the scope of the invention to make the projection 8 made not a part of the shaped element 7, but as an independent, dismountable separate part, which can be disassembled if the machine is going to knit another type of the fabric.

While we have disclosed one embodiment of the present invention, it is to be understood that this embodiment is given by example only and not in a limiting sense.

What we claim is:

1. An improved thread cutting device in a circular knitting machine having a plurality of cylinder needles for the production of hosiery goods, comprising a stationary cutting blade arranged on the dial, feed means for feeding thread, a circular cutting saw and a shaped element mounted above it so that on a part of the arc in front of the stationary cutting blade with respect to the rotary direction of the machine the shaped element covers a portion of the teeth of the circular cutting saw, the improvement comprising that above a part of the shaped element in front of the stationary cutting blade with respect to the rotary direction of the machine in the path of threads being fed by said thread feed means a thread is being drawn by one of said cylinder needles, there is operatively mounted a projection for lengthening said thread between said needle and said circular cutting saw.

2. The improvement in a thread cutting device according to claim 1, wherein said projection is of an arcuate shape, while in cross-section it has a shape of a point and at the beginning there is a transverse edge to catch-up the thread.

3. The improvement in a thread cutting device according to claim 2, wherein said projection together with the edge of said shaped element form a cutout in which the caught-up thread is laid and transported to said cylinder needle.

* * * * *